US005152076A

United States Patent [19]

Virta et al.

[11] Patent Number: 5,152,076

[45] Date of Patent: Oct. 6, 1992

[54] METHOD AND DEVICE IN A PAPER MACHINE

[75] Inventors: Raimo Virta; Vesa Vuorinen, both of Turku, Finland

[73] Assignee: Valmet Paper Machinery Inc., Finland

[21] Appl. No.: 618,000

[22] Filed: Nov. 26, 1990

[30] Foreign Application Priority Data

Dec. 1, 1989 [FI] Finland ..... 895749

[51] Int. Cl.[5] ..... F26B 11/02; F26B 3/00

[52] U.S. Cl. ..... 34/16; 34/117; 34/115

[58] Field of Search ..... 34/115, 117, 120, 114, 34/123, 122, 16, 18

[56] References Cited

U.S. PATENT DOCUMENTS 4,698,919 10/1987 Wedel ..... 34/117

*Primary Examiner*—Henry A. Bennet

*Attorney, Agent, or Firm*—Steinberg & Raskin

[57] ABSTRACT

The invention concerns a method and an apparatus in a paper machine, in particular in its drying section, for intensification of the drying of the paper. In the method the paper web (W) is passed on support of a drying fabric onto a drying cylinder (K). In the method, in connection with the drying cylinder (K), a separate suction device (10) is employed, which is fitted at a distance (F) from the drying fabric, e.g. a wire (H), which follows the face of the drying cylinder. In the method, by means of the suction device (10), the boundary layer ($S_1$) of moist air, which has been formed on the face of the drying fabric (H), is suctioned off, whereby the drying process is promoted.

18 Claims, 5 Drawing Sheets

METHOD AND DEVICE IN A PAPER MACHINE

BACKGROUND OF THE INVENTION

The invention concerns a method and an apparatus in a paper machine, in particular in its drying section.

In particular in the area of twin-wire draw, in the pocket space defined by the wire, the paper, and a cylinder, there is a high moisture level in the air. The movement of the wire produces a so-called pumping by the wire, whereby moist air is transferred from the wedge-shaped pocket between the wire and the cylinder into the nip point between the wire and the cylinder and from there further, in connection with the pocket and in particular in the nip, into the wire and through the wire, whereby a boundary layer of moist air is formed at the opposite side of the wire. This boundary layer of moist air does not provide optimal conditions for the process of drying of the paper web in the drying section of the paper machine. On the contrary, this boundary layer of moist air has a negative effect on the drying process.

SUMMARY OF THE INVENTION

Attempts have been made to find an improvement in the drying of the paper web in the drying section of a paper making machine. In the invention, the drying process has been improved by eliminating this boundary layer of moist air from the face of the wire immediately on its formation. The invention has functioned to replace this boundary layer of moist air by warm and dry replacement air. By means of the replacement air, a new boundary layer has been formed, which boundary layer is similar to the replacement air. Thereby the web drying capacity is optimized.

The invention has also made it possible to utilize the velocity of the moist boundary layer on the wire in the transfer of the moist boundary layer out of contact with the wire. Thereby the pressure losses remain low.

With a view to achieving a uniform drying profile, according to the invention a negative pressure of desired magnitude has been produced in suction blocks, a number of suction blocks being provided side by side across the cylinder width and the wire width. In a corresponding way, are a number of replacement air blow blocks are placed side by side.

In a preferred embodiment of the apparatus in accordance with the invention, the height of the suction device can be adjusted and, in a corresponding way, the height of the device for supply of replacement air is adjustable. Thus, in accordance with the height of the boundary layer of moist air, it is possible to adjustably achieve an optimal position for the suction and blow boxes.

The method in accordance with the invention is mainly characterized in that, in the method, in connection with the drying cylinder, a separate suction device is employed, which is fitted at a distance from the drying fabric, e.g. a wire, which follows the face of the drying cylinder, whereby, in the method, by means of the suction device, the boundary layer of moist air which has been formed on the face of the drying fabric, is suctioned off, whereby the drying process is promoted.

The apparatus in accordance with the invention is mainly characterized in that the apparatus comprises a suction device, which is fitted at a distance from the faces of the drying cylinder and of the wire, whereby, by means of the suction device, the boundary layer of moist air is suctioned out of contact with the drying fabric, such as a wire.

The group of drying cylinders in accordance with the invention is mainly characterized in that the group of drying cylinders in the drying section of the paper machine comprises, in connection with at least one drying cylinder, a unit consisting of a suction device and a device for supply of replacement air jointly operative with each other, whereby the boundary layer of moist air, which has been formed on the face of a fabric, such as a wire, in the paper machine, is sucked out of contact with the face by means of the suction device, and whereby, by means of the device for supply of replacement air, into contact with the fabric in the paper machine, such as a wire, in place of the boundary layer of moist air that had been suctioned away, a boundary layer of warm and dry replacement air of substantially equal height is supplied, the process of drying of the web being promoted by means of the warm and dry replacement air.

BRIEF DESCRIPTION OF THE DRAWINGS

The invention will be described hereinafter with reference to some preferred embodiments of the invention illustrated in the figures in the accompanying drawings, the invention being, however, not assumed to be confined to these embodiments alone.

DESCRIPTION OF THE PREFERRED EMBODIMENTS

Figure 1:
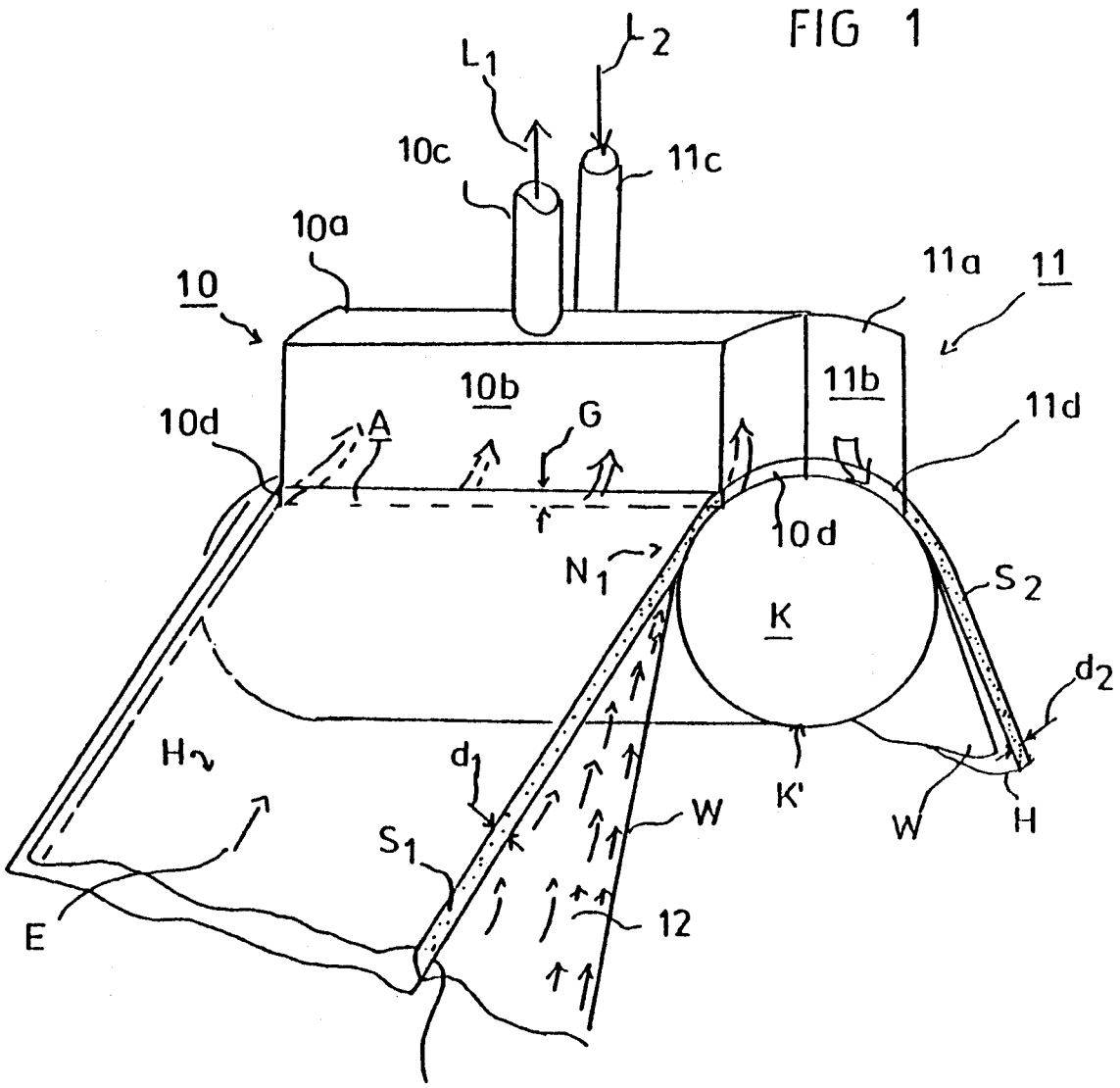
FIG. 1 is an axonometric and partly schematic view of the method and the apparatus in accordance with the invention.

FIG. 1 is an illustration of the principle of the method and the apparatus in accordance with the invention. A drying cylinder in the drying section of a paper machine is denoted with the reference letter K. The paper web W and the drying fabric of the paper machine, such as a wire H, are passed over the drying cylinder. Thermal energy, such as warm steam, is introduced into the cylinder K to evaporate the liquid and water out of the web W. In the embodiment of FIG. 1, the wire H runs on the top, whereas the web W remains between the face of the drying cylinder and the wire H. A so-called pumping effect of the wire H produces a boundary layer $S_1$ on the surface of the wire H. In order to eliminate this boundary layer $S_1$ of moist air, which is unfavorable for the drying, an apparatus in accordance with the invention has been fitted in connection with the outlet side of the drying cylinder $K_1$, this apparatus comprising, viewed in the direction $E_1$ of running of the wire and the web, a suction device 10, which is fitted at a distance from the wire H face, and preferably at the distance of the thickness $D_1$ of the boundary layer $S_1$. The thickness $D_1$ of the boundary layer $S_1$ of moist air is, as a rule, less than 100 mm.

As is shown in FIG. 1, the suction device 10 is fitted to suck the boundary layer $S_1$ off the wire H surface. The suction device 10 comprises a box construction 10*a*, which is fitted across the entire roll width and defines, in its interior, a suction space 10, out of which the moist air is suctioned away along the duct 10*c* by means of a blower device or an equivalent arrangement. The edges $10a_1$ and $10a_2$ of the box construction 10*a* comprise edge seals 10*d*, which are pressed against the face of the drying cylinder in the lateral areas of the drying cylinder. The function of the edge seals 10*d* is to prevent lateral leakages and to apply the suction exclusively to the desired area, i.e. to the wire H surface. The boundary layer $S_1$ has a certain velocity, whereby the kinetic energy of the boundary layer can be utilized in the removal of the boundary layer. Only a little negative pressure is required, which is produced by means of a pump device to divert the boundary layer into the outlet duct 10*c*.

As is shown in FIG. 1, after the suction device 10, the apparatus further comprises a device 11 for supply of replacement air jointly operative with the suction device 10, by means of which device 11 dry and warm replacement air is introduced in place of the boundary layer $S_1$ of moist air. In this way a boundary layer $S_2$ of dry air is formed, which promotes the drying process.

Similarly to the suction device, the device 11 for supply of replacement air comprises a box construction 11*a*, the air being first blown out of the duct 11*c* into the space 11*b* defined by the box construction in its interior and being then applied from the space 11*b* in the interior of the box construction to the wire H surface. Thus, immediately upon removal of the boundary layer $S_1$ of moist air, replacement air is introduced into this space above the wire H and a new boundary layer $S_2$, consisting of dry and warm air, is formed. The height $D_2$ of the boundary layer $S_2$ of dry and warm air, which has been formed in place of the boundary layer of moist air, is substantially equal to the height of the boundary layer $S_1$ of moist air.

In a corresponding manner, the device 11 for supply of replacement air comprises edge seals 11*d*, which are placed at both edges $11a_1$ and $11a_2$ of the box construction and are pressed against the lateral areas of the drying cylinder K. In this way the supply of replacement air is applied exclusively to the desired area on the wire H, a lost flow of replacement air being prevented from leaving the lateral area of the device 11 which supplies replacement air into the air space in the hood surrounding the drying cylinder K.

In FIG. 1, the arrow $L_1$ illustrates the removal of air by means of the suction device 10 and, in a corresponding manner, the arrow $L_2$ illustrates the supply of replacement air through the device 11 for supply of replacement air into connection with the wire H. In the suction, a blower (not shown) is used and, in a corresponding way, in the supply of replacement air, a blower (not shown) is used. The operation of the suction device 10 can be adjusted by adjusting the height of the inlet opening A of the suction device from the wire face.

In the present application, when a wire is spoken of, a drying fabric of a paper machine is meant.

Figure 2:
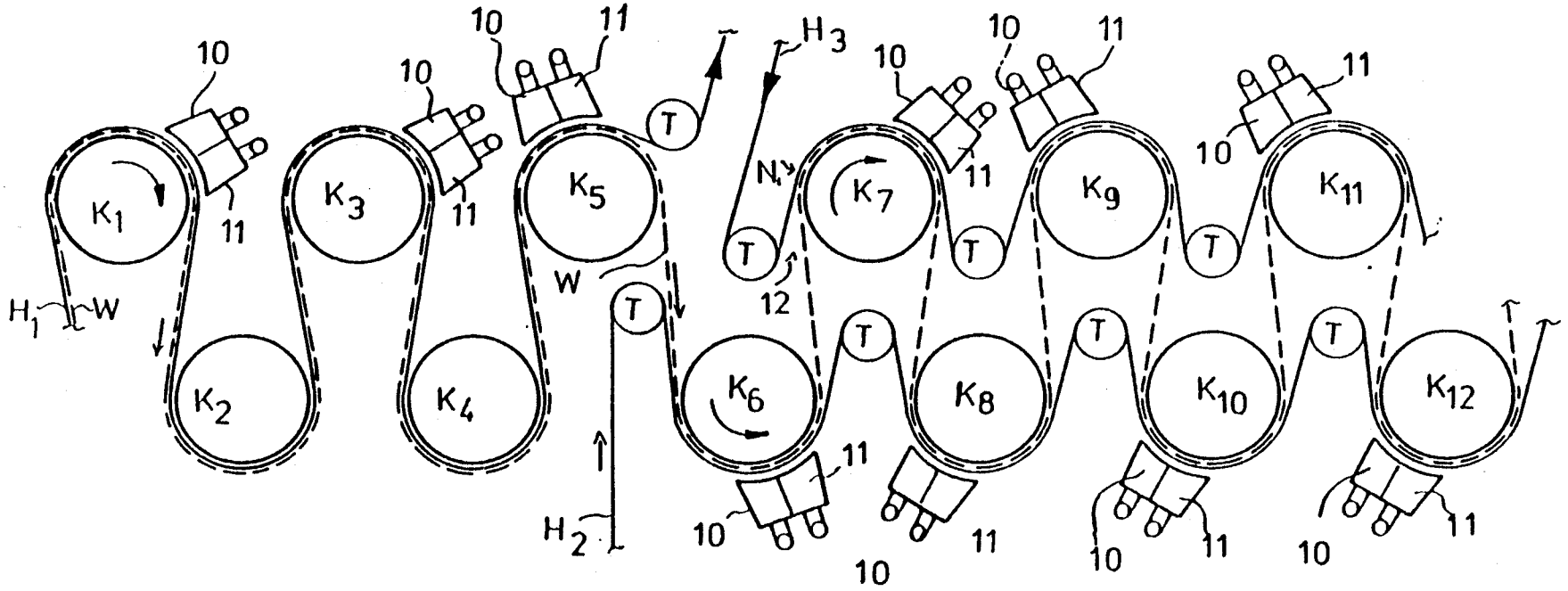
FIG. 2 shows an apparatus in accordance with the invention in the drying section of a paper machine which is provided both with single-wire draw and with twin-wire draw.

FIG. 2 shows an arrangement of an apparatus in accordance with FIG. 1 as fitted in connection with single-wire draw and twin-wire draw in a drying section of a paper machine. In the figure, only a part of the drying group is shown. In the figure, the reference letters $K_1$ $K_2$ . . . $K_5$ denote drying cylinders in a single-wire group, and the reference numerals $K_6$, $K_7$ . . . $K_{12}$ denote drying cylinders in the drying group with twin-wire draw. The first drying fabric is denoted with the reference numeral $H_1$, the second drying fabric with the reference numeral $H_2$, and the third drying fabric is denoted with the reference numeral $H_3$.

In the figure, the guide and leading rolls of the drying fabrics are denoted with the reference letters T. In single-wire draw, the wire H runs a loop from the upper cylinder $K_1$ onto the lower cylinder or roll $K_2$ and further onto the upper cylinder $K_3$ and further, in a corresponding way, onto the last cylinder $K_5$ in the group. In this first group of drying cylinders in the drying section, the drying fabric, i.e. the wire $H_1$, runs on the top and, on each cylinder, the paper web W runs between the wire $H_1$ and the cylinder face.

In the embodiment shown in FIG. 2, the apparatus 10, 11 in accordance with the invention is fitted in the area of single-wire draw in connection with the drying cylinders $K_1$, $K_3$ and $K_5$ at the outlet side of the drying cylinder.

From the drying cylinder $K_5$ the web W is transferred into the area of twin-wire draw in the drying section and onto its first lower drying cylinder $K_6$. As is shown in the figure, this drying group with twin-wire draw comprises the lower drying cylinders or rolls $K_6$, $K_8$, and $K_{12}$ as well as the upper drying cylinders $K_7$, $K_9$ and $K_{11}$.

At the lower drying cylinders with twin-wire draw, the run of the web is supported by means of the wire draw $H_2$, and at the upper drying cylinders by means of the wire draw $H_3$.

In the area of the drying group with twin-wire draw, the apparatus 10, 11 for suction and for supply of replacement air in accordance with the invention is placed, at the first drying cylinder $K_6$, in connection with its outlet side and at the drying cylinders $K_7$, $K_8$, $K_9$, $K_{10}$, $K_{11}$ and $K_{12}$ in connection with the inlet side of the cylinder after the so-called pumping-out nip $N_1$ of the pocket 12.

Figure 3:
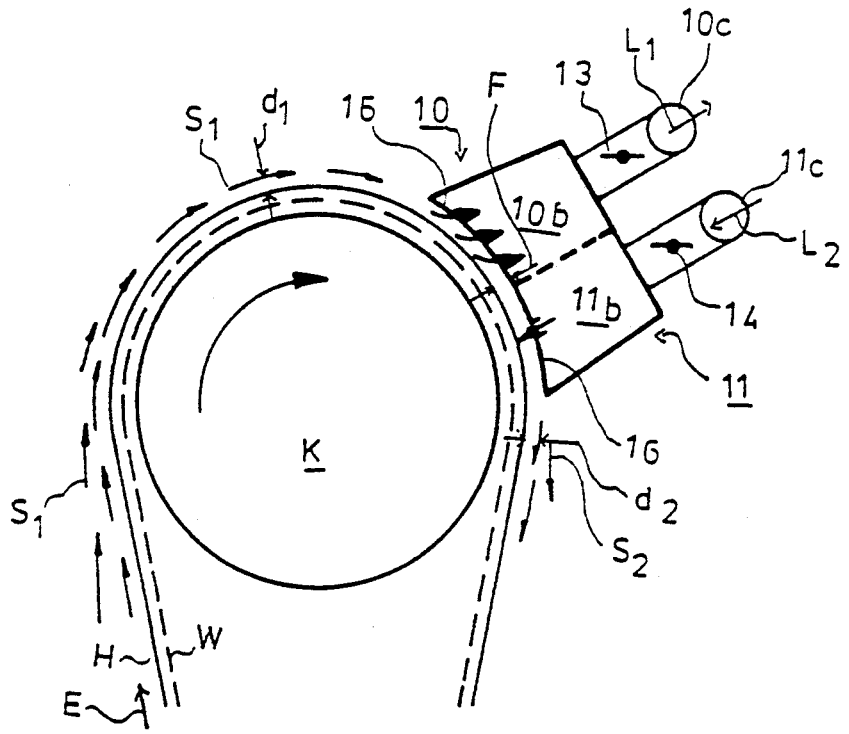
FIG. 3 is a side view of an apparatus in accordance with the invention in connection with a drying cylinder with single-wire draw in the drying section of a paper machine.

FIG. 3 shows an apparatus in accordance with the invention in connection with the outlet side of a drying cylinder K in a drying group with single-wire draw in the drying section of a paper machine. In the figure, the boundary layer of moist air is denoted with $S_1$, and the boundary layer of replacement air formed in its place with $S_2$. In the manner shown by the arrow $L_1$, the boundary layer $S_1$ of moist air is sucked by means of the suction device 10 out of contact with the wire H and, in the manner indicated by the arrow $L_2$, a boundary layer $S_2$ of replacement air is supplied in place of the boundary layer $S_1$ of moist air. The direction of running for the wire and of the web is denoted with the arrow E. The outlet duct 10*c* for moist air includes a regulating damper 13 or equivalent, by means of which the suction capacity can be adjusted and, in a corresponding way, the device 11 for supply of replacement air includes a regulating damper 14 or equivalent in the duct 11*c*, by means of which the supply of replacement air into connection with the wire H can be regulated.

When the throttle of the flows $L_1$ and $L_2$ is minimized by means of the regulating dampers 13 and 14, the drying capacity is at the maximum.

Figure 4:
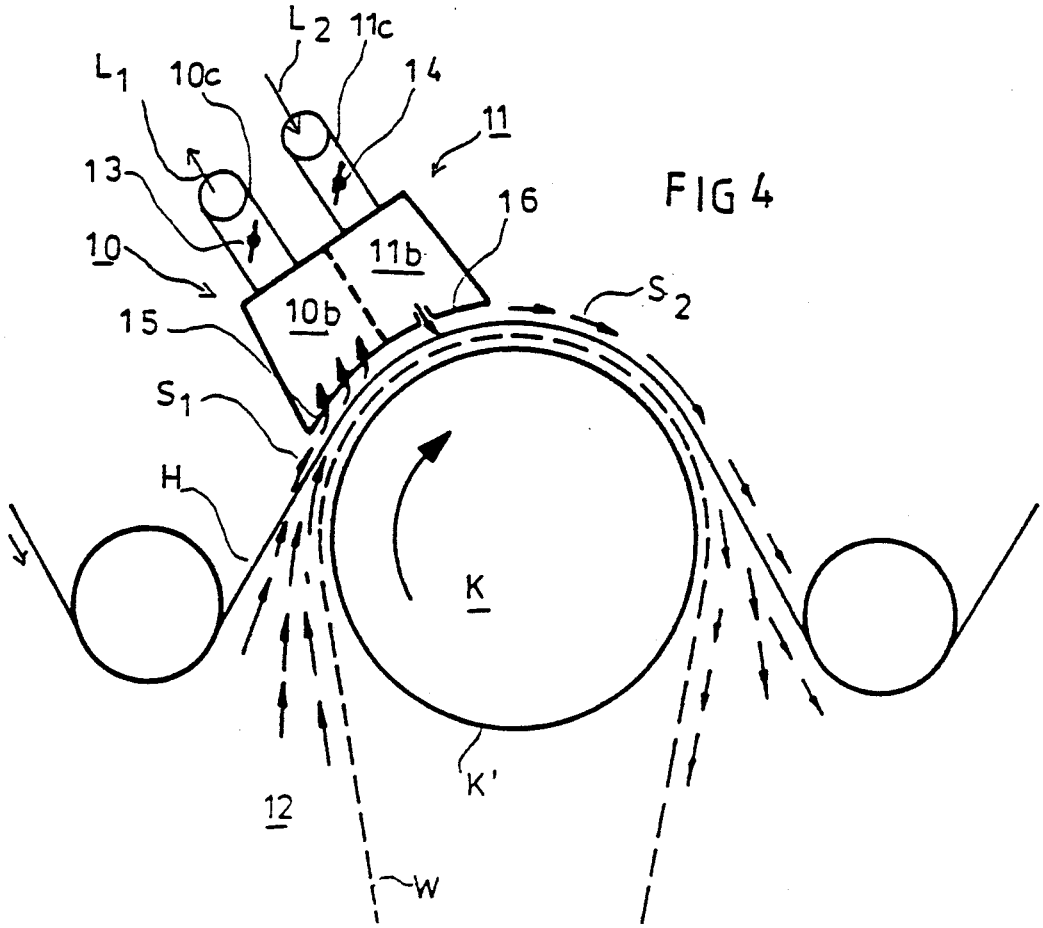
FIG. 4 is a side view of an apparatus in accordance with the invention in connection with a drying cylinder with twin-wire draw in the drying section of a paper machine.

FIG. 4 shows an apparatus 10, 11 in accordance with the invention in connection with a drying cylinder K in a group of drying cylinders with twin-wire draw in a drying section of a paper machine. The wedge-shaped pocket 12 between the outer face K' of the drying cylinder K and the wire H produces a so-called pumping effect, and the moist air present in the pocket flows through the so-called pumping-out nip $N_1$, and the boundary layer of moist air that was formed is removed immediately after the nip $N_1$ by means of the suction device 10. Dry and warm replacement air is introduced in place of the boundary layer, and a boundary layer $S_2$ of dry and warm air is formed in place of the boundary layer, and a boundary layer $S_2$ of dry and warm air is formed in place of the boundary layer $S_1$ of moist air. Thus, optimal conditions are formed for the drying process.

The apparatus shown in FIG. 4 also includes both a regulating damper 13 in the suction device 10 and a regulating damper 14 in the device 11 for supply of replacement air, the suction and replacement-air flows $L_1$, $L_2$ being regulated by this regulation means.

In the manner shown in FIGS. 3 and 4, the bottom faces 15 and 16 of the suction device and of the device for supply of replacement air are placed at a distance F from the wire H surface. The distance F is, especially at the suction side, the same as the height $D_1$ of the boundary layer of moist air. The curved bottom face 15 of the suction device 10 is advantageously a face which comprises perforations or other, corresponding suction openings, through which the air is sucked into the suction space 10*b* in the box construction 10*a*. In a corresponding way, the device 11 for supply of replacement air has a curved bottom face 16, which comprises slot nozzles in the transverse direction of the web or merely a perforated face, through which the flow of replacement air is applied to the moving wire H.

Figure 5A:
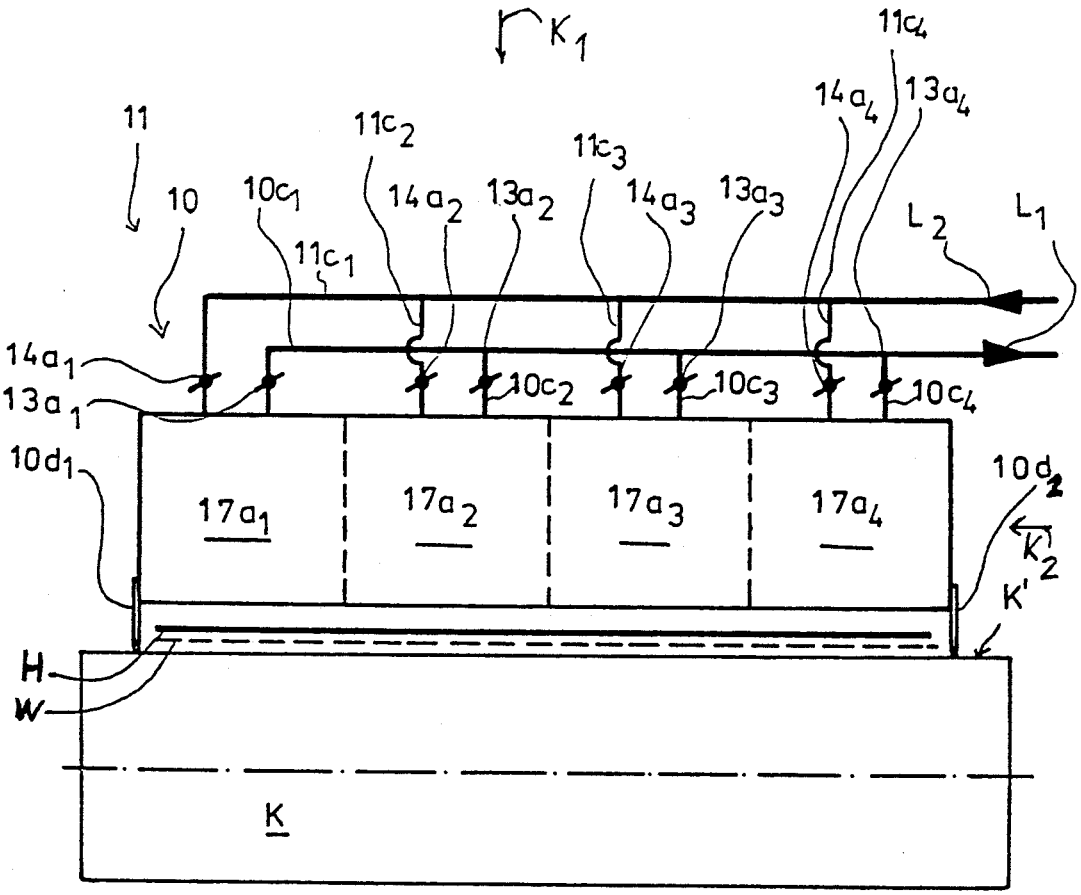
FIG. 5A is an illustration in the machine direction of an embodiment apparatus in accordance with the invention has been placed across the roll width, this apparatus promoting the drying process and comprising a number of suction and blow blocks placed side by side.

FIG. 5A shows an apparatus in accordance with the invention as viewed in the machine direction, an embodiment being shown in which the boundary layer of moist air is sucked through a number of separate blocks $17a_1$, $17a_2$ . . . $17a_n$ in the suction device 10. In the figure, an embodiment is shown in which the number of blocks in the suction device 10 in the direction of width of a suction cylinder is four, $17a_1$, $17a_2$, $17a_3$ and $17a_4$. Behind each of the blocks $17a_1$, $17a_2$, $17a_3$ and $17a_4$, there is a block $18a_1$, $18a_2$, $18a_3$, and $18a_4$ in the device 11 for supply of replacement air.

By means of the apparatus in FIG. 5A, the drying process can be regulated as desired across the width of the roll. The requirement of drying in the direction of width of the paper web is different depending on the position in relation to the width. In the embodiment of FIG. 5A, the jointly operative blocks $17a_1$, $18a_1$, $18a_2$, $17a_3$, $18a_3$ . . . $17a_n$, $18a_n$ in the suction device and in the device for supply of replacement air are regulated at the same time. Thus, when a more intensive suction is applied by means of a certain block in the suction device 10, a corresponding larger quantity of replacement air is supplied by mean of the block for supply of replacement air placed behind this suction block. In the figure, the suction duct passing to each of the blocks in the suction device 10 is denoted with the reference numerals $10c_1$, $10c_2$, $10c_3$ and $10c_4$, and, correspondingly, in the figure, the ducts passing to the blocks in the device for supply of replacement air are denoted with $11c_1$, $11c_2$, $11c_3$ and $11c_4$.

In the ducts passing to the blocks 17*a*, the suction device 10 includes flow regulation means, preferably regulation dampers $13a_1$, $13a_2$, $13a_3$ and $13a_4$, and, in a corresponding way, in the ducts $11c_1$, $11c_2$, $11c_3$ and $11c_4$ passing into the blocks $18a_1$, $18a_2$, $18a_3$ and $18a_4$, the device 11 for supply of replacement air includes flow regulation means, preferably regulation dampers $14a_1$, $14a_2$, $14a_3$ and $14a_4$.

As is shown in FIG. 5A, the edges of the extremity blocks $17a_1$ and $17a_4$;$18a_1$ and $18a_4$ in the suction device 10 and in the device 11 for supply of replacement air are provided with edges seals $10d_1$ and $10d_2$;$11d_1$, $11d_2$. The mechanical seals $10d_1$ and $10d_2$;$11d_1$ and $11d_2$ are pressed against the upper face of the drying cylinder K and thereby prevent leakage flow to and from the sides of the drying cylinder.

Figure 5B:
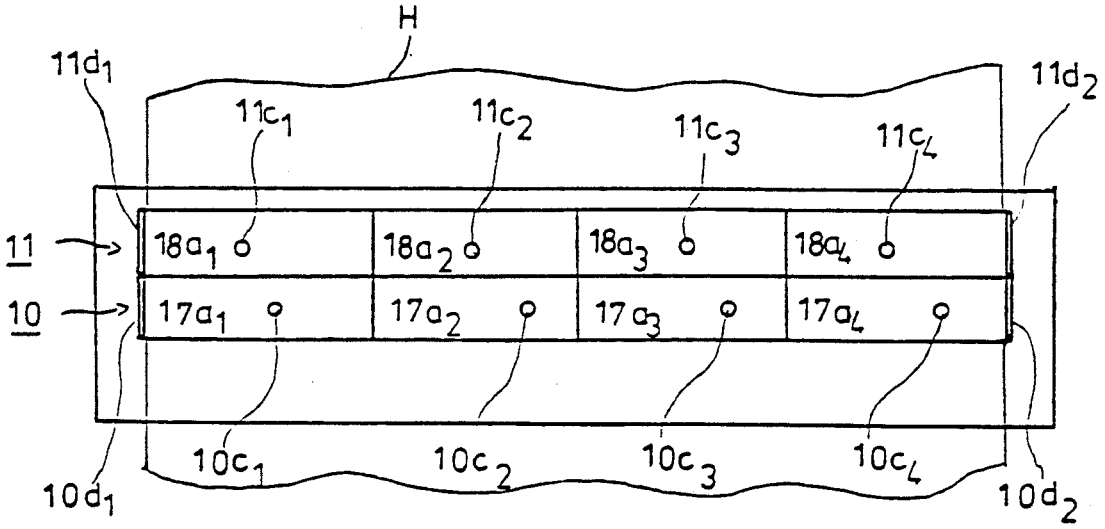
FIG. 5B shows the apparatus of FIG. 5A viewed in the direction of the arrow $K_1$.

FIG. 5B shows the apparatus of FIG. 5A in the direction o the arrow $K_1$ in FIG. 5A, i.e. from above. As is shown in the figure, the equipment comprises a block $18a_1$ . . . for supply of replacement air in the device 11 for supply of replacement air in connection with, and immediately behind, each suction block $17a_1$ . . . in the suction device 10, seen in the direction of running of the wire. The distance between the suction device and the device for supply of replacement air is as short as possible but, yet, such that the suction process and the process of supply of replacement air do not interfere with each other, so that the flows $L_1$ and $L_2$ are not mixed together.

Figure 5C:
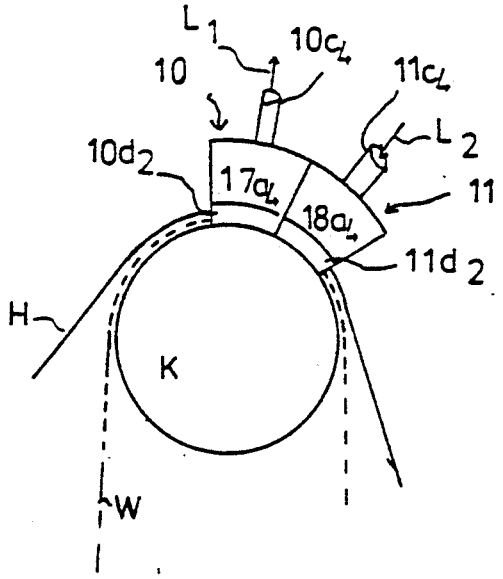
FIG. 5C shows the apparatus of FIG. 5A viewed in the direction of the arrow $K_2$.

FIG. 5C shows the apparatus of FIG. 5A viewed in the direction of the arrow $K_2$ in FIG. 5A, i.e. from the side of the drying cylinder.

Although preferred embodiments of the subject invention have been shown herein, it is submitted that numerous other embodiments within the scope of the appended claims will readily occur to those skilled in the art.

What is claimed is:

1. A method for intensification of the drying of paper in the drying section of a paper making machine, said method comprising the steps of:

passing a paper web supported by a drying fabric onto a drying cylinder;

positioning a suction device facing and at a distance from a section of said fabric running on said drying cylinder whereby a boundary layer of moist air formed on the face of said drying fabric is diverted to said suction device utilizing the velocity of the boundary layer of moist air and negative pressure from said suction device, and positioning a device for supplying replacement air facing said drying fabric, after said suction device, such that a boundary layer of replacement air is formed in place of said boundary layer of moist air.

2. The method of claim 1, further comprising positioning said suction device at the outlet side of said drying cylinder in the direction of running of said drying fabric.

3. The method of claim 1, further comprising positioning said suction device so as to remove said boundary layer of moist air in the direction of running of said drying fabric after a nip formed between said drying fabric and the face of said drying cylinder.

4. The method of claim 1, further comprising using a regulation damper in said suction device and a regulation damper in said device for supplying replacement air.

5. The method of claim 1, further comprising adjusting said distance of said suction device from said drying fabric in accordance with the height of said boundary layer of moist air.

6. The method of claim 1, further comprising positioning said suction device at a distance from said drying fabric equal to the height of said boundary layer of moist air.

7. The method of claim 1, further comprising regulating the suction capacity of said suction device in accordance with the distance of the inlet opening of said suction device from said drying fabric.

8. The method of claim 1, further comprising using as said suction device a device comprising a plurality of suction blocks which extend across the width of said drying cylinder, and adjusting the suction in each of said suction blocks to a desired level.

9. The method of claim 8, further comprising using a block for supplying replacement air in the direction of running of said drying fabric after each of said plurality of suction blocks, and adjusting the supply of replacement air from said respective blocks for supplying replacement air.

10. An apparatus for intensification of the drying of paper in the drying section of a paper machine having a drying cylinder upon which a paper web supported by a drying fabric runs, said apparatus comprising:

a suction device including a bottom face positioned facing a section of said drying fabric running on said drying cylinder, said bottom face being curved in conformance with the curvative of a corresponding section of said drying cylinder, said bottom face being perforated and positioned in proximity to a boundary layer of moist air formed on the face of said drying fabric, said boundary layer being diverted to said suction device utilizing the velocity of the boundary layer of moist air and negative pressure from said suction device, and a device for supplying replacement air positioned facing said drying fabric and in the direction of running of said drying fabric after said suction device, said device for supplying replacement air adapted to form a boundary layer of replacement air in place of said boundary layer of moist air.

11. The apparatus of claim 10, wherein said suction device comprises a damper for regulating air flow and said device for supplying replacement air comprises a damper which regulates the flow of replacement air.

12. The apparatus of claim 10, wherein said suction device comprises edge seals at its lateral perimeter for preventing leakage flow of suction air at said lateral perimeter.

13. The apparatus of claim 11, wherein said device for supplying replacement air comprises edge seals at its lateral perimeter for preventing leakage flow of replacement air at said lateral perimeter.

14. The apparatus of claim 10, wherein said suction device comprises a plurality of suction blocks respectively placed at different positions across the width of said drying cylinder and each suction block comprises a damper for regulating suction air flow.

15. The apparatus of claim 14, further comprising a plurality of blocks for supplying replacement air, each of said plurality of blocks for supplying replacement air positioned in the direction of running of said drying fabric after a respective suction block and each block for supplying replacement air comprising a damper for regulating the supply of replacement air.

16. An apparatus within a drying section of a paper making machine comprising:

a plurality of drying cylinders spaced apart from each other at substantially the same height;

another plurality of drying cylinders spaced apart from each other at substantially the same height;

another plurality of drying cylinders spaced apart from each other at substantially the same height and below said plurality of drying cylinders such that a paper web and a drying fabric supporting said paper web can be passed downwards from one of said plurality of drying cylinders to one of said another plurality of drying cylinders and then upwards to another of said plurality of drying cylinders;

means for producing thermal energy to remove liquid from said web;

a suction device including a bottom face positioned facing a section of said drying fabric running on said drying cylinder, said bottom face being curved in conformance with the curvative of a corresponding section of said drying cylinder, said bottom face being perforated and positioned in proximity to a boundary layer of moist air formed on the face of said drying fabric, said boundary layer being diverted to said suction device utilizing the velocity of the boundary layer of moist air and negative pressure from said suction device; and a device for supplying replacement air positioned facing said drying fabric and, in the direction of running of said drying fabric, after said suction device, said device for supplying replacement air adapted to form a boundary layer of replacement air in place of said boundary of moist air.

17. The apparatus of claim 16, wherein said suction device and said device for supplying replacement air are positioned in the direction of running of said drying fabric after a nip formed between said drying fabric and the face of said drying cylinder.

18. The apparatus of claim 16, wherein said suction device and said device for supplying replacement air are positioned at the outlet side of said drying cylinder in the direction of running of said drying fabric.

* * * * *